US010562601B2

(12) United States Patent
McLaughlin

(10) Patent No.: US 10,562,601 B2
(45) Date of Patent: Feb. 18, 2020

(54) PERSONAL FLOTATION DEVICE WITH PASSIVE LOCATION AND IDENTIFICATION SYSTEM AND METHOD OF USE

(71) Applicant: Erin McLaughlin, Hinsdale, IL (US)

(72) Inventor: Erin McLaughlin, Hinsdale, IL (US)

( * ) Notice: Subject to any disclaimer, the term of this patent is extended or adjusted under 35 U.S.C. 154(b) by 0 days.

(21) Appl. No.: 16/027,546

(22) Filed: Jul. 5, 2018

(65) Prior Publication Data

US 2019/0009869 A1 Jan. 10, 2019

Related U.S. Application Data

(60) Provisional application No. 62/528,925, filed on Jul. 5, 2017.

(51) Int. Cl.

| | |
|---|---|
| ***B63C 9/20*** | (2006.01) |
| ***B63C 9/08*** | (2006.01) |
| ***B63C 9/11*** | (2006.01) |

(52) U.S. Cl.

CPC ..... *B63C 9/20* (2013.01); *B63C 9/08* (2013.01); *B63C 9/11* (2013.01)

(58) Field of Classification Search

CPC .... B63C 9/00; B63C 9/08; B63C 9/20; B63C 9/115; B63C 9/125; B63C 9/1255; B63C 9/13

USPC ..... 441/89, 11, 80

See application file for complete search history.

(56) References Cited

U.S. PATENT DOCUMENTS

| | | | | |
|---|---|---|---|---|
| 51,971 | A | 1/1866 | Roussiel | |
| 2,118,708 | A | 5/1938 | Johnson | |
| 4,598,661 | A | 7/1986 | Roe | |
| 5,029,551 | A | 7/1991 | Rosen | |
| 5,083,956 | A | 1/1992 | Chraghchian et al. | |
| 5,403,219 | A * | 4/1995 | Ryan | B63B 22/00 441/89 |
| 5,423,282 | A | 6/1995 | Krull et al. | |
| 5,651,711 | A | 7/1997 | Samano | |
| 5,671,480 | A | 9/1997 | Krout et al. | |
| 5,893,786 | A | 4/1999 | Stevens | |
| 6,220,910 | B1 | 4/2001 | Richey | |
| 6,289,840 | B1 | 9/2001 | Hill | |
| 6,666,622 | B1 | 12/2003 | Courtney et al. | |
| 6,749,473 | B1 | 6/2004 | Lower | |
| D829,382 | S | 9/2018 | McLaughlin | |

(Continued)

*Primary Examiner* — Lars A Olson

(74) *Attorney, Agent, or Firm* — Advitam IP, LLC.

(57) ABSTRACT

A Personal Flotation Device (PFD), in the form of a vest or like garment, and having a quiver-like receptacle attachment, hinged to the garment for flexibility, is provided. The quiver attachment houses a mast and flag attached to a small flotation device, such that when the user enters the water the flotation device causes the mast and attached flag to rise so that the flag can be seen from a distance and the wearer identified thereby. The quiver element is attached such that it can place the extended mast and flag unobtrusively and at a distance from the wearer's head for comfort. The quiver element comprises a housing for the mast and flotation device and is permeable to water; the quiver element is shaped to guide the mast and flag linearly at an angle to the longitudinal axis of the wearer. The device allows for the flag to be interchanged with other flags so as to better identify the wearer from other users.

14 Claims, 14 Drawing Sheets

(56) References Cited

U.S. PATENT DOCUMENTS

| | | | | |
|---|---|---|---|---|
| 2008/0045100 | A1 | 2/2008 | Dungan | |
| 2011/0097952 | A1* | 4/2011 | Pirie | B63C 9/20 441/89 |

* cited by examiner

PERSONAL FLOTATION DEVICE WITH PASSIVE LOCATION AND IDENTIFICATION SYSTEM AND METHOD OF USE

FIELD OF THE INVENTION

The present invention concerns the creation and use of personal flotation devices (PFDs) with a location and identification means. More particularly the present invention concerns life vests, jackets and other personal flotation devices having a passive location and identification system, such as an elevated flag, to help in the location of the individual wearing the device.

BACKGROUND OF THE INVENTION

Persons making contact with bodies of water have been advised, for many years, that for personal safety a personal flotation device (PFD), such as a life vest or a life jacket, should be provided for each person in such contact and worn. For example, in boating, the US Coast Guard requires that on a vessel underway, children under 13 must wear an approved PFD, unless they are below decks or in an enclosed cabin. Additionally, boating regulations, rules and laws typically require that there be at least one life jacket for each person aboard a vessel.

Most particularly, however, many parents of toddlers and small children are using PFD's on such children whenever the child is in or near a swimming pool. Because of the increase in accidental drowning by small children in relatively shallow pools, there is an increased demand for PFD's to help prevent such catastrophes.

The object of the PFD is to provide the user with flotation in such a manner that the face of the individual is caused to be above the surface of the water no matter the conscious state of the user. This is typically accomplished by having the front and the front upper surface of the PFD include more flotation material than any other part of the device, thereby causing the user's buoyancy to be highest in the front and near the face. A user who falls face first into water using a properly placed PFD will naturally be rotated, by the buoyancy forces, so as to end face up in the water. While this position is ideal for life preservation, the result is that substantially the entire vest is submerged or at least not very visible; the bright or reflective colors and materials of the vest are ineffective to help locate the user in water.

Additionally, in summertime and other weather or locations where swimming is likely, pools and beaches are typically filled with children such that it is difficult, at a distance, to differentiate one child from another. Whether the child is wearing or not wearing a PFD the child is fungible with other children at a distance who may also be wearing a PFD. As cautious parents are requiring their children to wear a PFD, such use provides an opportunity to distinguish children by the color or appearance of the vest. However, since most vests are made in colors designed to be easily visible in any situation, most vests are similar to each other, and selecting one's child on this basis is still difficult.

Traditional life vests do not provide an effective locating feature to locate and track a user because traditional life vests are meant to be a safety precaution to help individuals float in water. Although conventional life vests may have reflective colors such as bright orange to help locate and track a user, solely relying on the color is ineffective. The problem is that traditional life vests are still difficult to see and locate in circumstances where visibility is an issue. Accordingly, traditional life vests do not provide a solution to this problem because majority of life vests still heavily rely on the reflective colors for locating purposes. Effective tracking, detecting, locating, and rescuing can be tremendously prolonged in circumstances where the reflective color of the life vest is negatively impacted. For example, rescuing a user wearing a traditional life vest in a lake or an ocean may be difficult where waves or inclement weather impedes the life vest itself, rendering the reflective color ineffective.

While some PFD's are manufactured with electronic homing systems and radio beacons to help find persons lost at sea, the implementation of such devices in ordinary PFD's is costly, adds weight to the PFD and is generally unnecessary in most recreational environments.

It is apparent that a need exists for a life vest system that inexpensively improves locating and tracking a user in circumstances where visibility may be an issue without solely relying on reflective colors.

It would be helpful to have a device that provided the user, with safety near and in the water and would have some non-fungible indicia that would help a parent, guardian or other supervisor to know quickly where the user is. In such situations it is equally important to have a device that passively provides the indicia without interfering with the flotation and lifesaving functions of the PFD. It would also be helpful if the device added little weight and costs to the overall PFD, and that the passive identification elements of the device could be used on land as well as in the water.

It is therefore an object of the present invention to provide a means for identifying a PFD-user at a distance while preserving the lifesaving function of the device. It is another object of the present invention to provide a locating feature that is passively employed such that the user can be identified no matter what condition of consciousness exists. It is also an object to provide an unobtrusive and inexpensive means to allow persons overseeing the user with a means to quickly find the user in a crowd, in the water or on the land.

Other objects and advantages of the present invention will become apparent as the description proceeds.

SUMMARY OF THE INVENTION

The present invention relates to life vests comprising a flag system used to locate individual users. More particularly, the present invention enables locating an individual wearing a life vest by incorporating a self-adjusting and operating flag system for identification purposes. Specifically, the life vest flag system uses water surrounding the life vest to extend and adjust the height of a visible identifier (such as a flag) relative to the user in order to more easily locate the user. More specifically, the life vest flag system comprises an automatic, height adjustable, buoyant device to improve locating a user in circumstances where visibility may be an issue. For example, the life vest flag system can be used for a variety of activities, including, but not limited to, boating, water-skiing, tubing, and wakeboarding. Toddlers can also use the system when swimming in crowded pools (having different colored and designed visible identifiers) so parents can quickly identify their children.

One benefit of the present invention is that it is not obtrusive because its design is comfortable, yet still functionally efficient. For example, one objective of the present invention pertains to providing an improved automatic, height adjustable, buoyant device to more efficiently locate a user in circumstances where visibility may be an issue. Another objective of the Applicant's invention is to provide a locating system without hindering a user's comfort level. Another objective of the present invention is to provide a locating system that is highly visible when submerged in waves or inclement weather. Specifically, a benefit of having this functionally efficient, yet non-obtrusive invention is that it truly improves locating a user in all conditions without impeding a user's personal space or comfort.

The method and application of the present invention stems from the innovative concept of inventing away from traditional life vests. Thereby advancing the art of life vests by providing an improved application to locate and rescue any vulnerable or submerged user. Particularly, the invention pertains to the application of a flotation device that raises and retracts a mast or pole comprising a highly visible identifier such as a reflective flag. More specifically, the system implements a buoyant flotation device that automatically raises or retracts the highly visible identifier by using the surrounding water a user may be submerged in. Furthering the application, the locating system is designed to ensure comfort because it is not obtrusive of a user's personal space.

The prior art discloses a life vest flag system for locating purposes and a method for the same. However, the Applicant's invention has key structural differences distinguishing it from the prior art. One benefit of the Applicant's invention is that it is structured and designed to functionally withstand larger forces of water. In particular, the system is structured to be enclosed in a pre-set receptacle comfortably positioned at an angle pointing away from the user's personal head space, where the receptacle fully encloses a housing, thereby preventing excess shifting from movement and/or water flow. An additional benefit is that the Applicant's invention implements a more buoyant system because its structure comprises a separate low profile flotation device designed to sit in a position at the bottom of the housing, which allows the use of a low-profile, more compact housing comprising surfaces that fully enclose the flotation device. Specifically, in one embodiment, the housing comprises two flat surfaces and a small passage for a thin mast/pole/rod, where both flat surfaces comprise of custom wave-like holes enhancing the water flow. Furthermore, the small passage for the thin mast/pole/rod is significantly smaller in structure and profile than the housing itself. Another benefit is that the mast/pole/rod has a stopper at the top, outside of the housing to prevent an excess retraction and damage to the flotation device. These key structural differences between the prior art and the Applicant's invention indicates the need for a solution to the problem discussed here. Therefore, with the provided solution, the present invention is advancing the art of life vests and making certain water activities safer.

In accordance with the present invention, a personal flotation device (PFD), such as a life vest, having a passive identification and location element is provided, comprising a garment, to be worn about the torso. The garment includes at least a back panel and a front panel, the back and front panels being fixed together to form the garment for providing buoyancy in water. Additionally, a pouch attached to the garment at the back panel, the pouch has an opening at the top and is permeable to water along its length and a container is provided for placement in the pouch. The container has a bottom, a top and walls; the walls have openings to allow the container to fill with water when it is placed in water. Within the container is placed a flotation device attached to a mast with an identifying element, such as a flag, attached to the mast. The flotation device rest generally at the bottom of the container when not in water and is configured to freely slide substantially within the entire length of the container. The mast extends from the flotation device and out from the top of the container.

When the PFD is placed in water, the container fills with water and the flotation device within the container is caused to float within the container, rising such that the attached mast extends out from the container in a generally upward direction carrying the identification device up so that it can help to identify the wearer from a distance.

While the personal flotation device (PFD) having a passive identification and location element would typically be used in water to allow the mast to rise, in one embodiment a locking element can be included, about the mast, such that the mast can be extended manually and locked in an erect position for use outside of water.

Because the device can be used for both identification purposes and lifesaving purposes, different embodiments include flotation materials that provide a neutral buoyancy to the wearer or lifesaving buoyancy to the wearer.

So as to cause the identification and location element, often a flag, to extend in a manner that does not disrupt the user, in some embodiments, the flotation device is made so as to fit closely within the container such that the container comprises a linear path for the flotation device to take when the PFD is placed in water. In a preferred embodiment, then the container is placed at an acute angle relative to vertical, such that when the mast and flag extend from the container, they are at an angle away from the wearer's head.

In another embodiment, a passive identification and location element for removable attachment to a person is provided separate from any garment. The device can then be attached to a person or a garment or can be fitted to an existing life vest or other PFD. The device comprises a pouch, with means to connect, such as by straps or belts or other means, to a person. The pouch has an opening at the top and is permeable to water along its length. Within the pouch is placed a container comprising a bottom, a top and walls, the walls having openings to allow the container to fill with water when placed in water. Within the container are placed a flotation device attached to a mast, which in turn is attached to an identifying element, such as a flag. When in the container, the flotation device rests generally at the bottom of the container, when not in water; the flotation device is configured to freely slide substantially within the entire length of the container with the mast extending from the flotation device. As the flotation device floats upwardly, the mast emerges out from the top of the container. In use then, when the passive identification and location element is attached to a person and is placed in water, the container fills with water and the flotation device within the container is caused to float within the container rising such that the attached mast extends distally from the container in a generally upward direction carrying the identification device therewith.

It will be understood that the present invention includes a method of using a passive identification and location device; including the steps of providing a water permeable container, providing a buoyant element and mast within the container, the mast having a proximal end and a distal end, the buoyant element being adjacent the proximal end of the mast, the distal end of the mast extending out from the container, providing an identification element, connectable to the distal end of the mast and providing means to removable attach the container to a person. The user then attaches the identification element to the mast and attaches the container to the person such that when the buoyant element is caused to rise, either by insertion into water or by manually raising the identification element, the buoyant element rises within the container, pushing the mast further out from the container and raises the identification element.

In some embodiments, the method of using a passive identification and location device further includes providing a pouch with flexible flanges, such that when the container is placed in the pouch, which is connected to the person through the flanges, the identification means is allowed to advantageously angle away from the person when in use. For use outside of water, the method includes providing a clip, such that the user can raise the mast and identification means manually, by pulling thereon, and then place the clip on a portion of the mast extending out from the container, and near the proximal end of the mast, so as to keep the identification means and mast extended.

A more detailed explanation of the invention is provided in the following description and claims and is illustrated in the accompanying drawings.

DETAILED DESCRIPTION OF THE ILLUSTRATIVE EMBODIMENT

Figure 1:
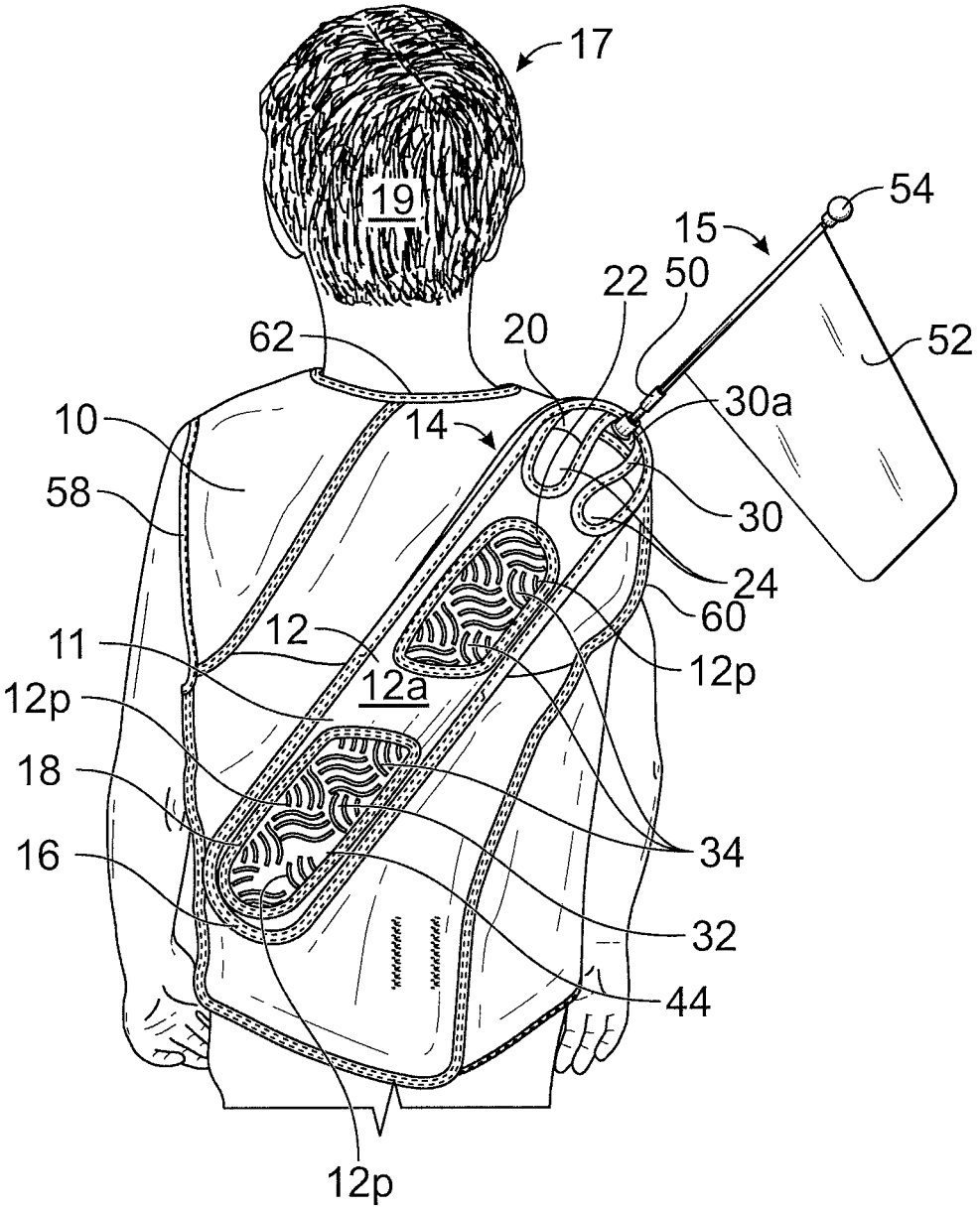
FIG. 1 is a rear elevational view of a Personal Flotation Device (PFD) of the present invention, being worn by a child.

While the present invention is susceptible of embodiments in various forms, there is shown in the drawings and will hereinafter be described some exemplary and non-limiting embodiments, with the understanding that the present disclosure is to be considered an exemplification for the invention and is not intended to limit the invention to the specific embodiments illustrated. In this disclosure, the use of the disjunctive is intended to include the conjunctive. The use of the definite article or indefinite article is not intended to indicate cardinality. In particular, a reference to "the" object or "a" object is intended to denote also one of a possible plurality of such objects.

Figure 9:
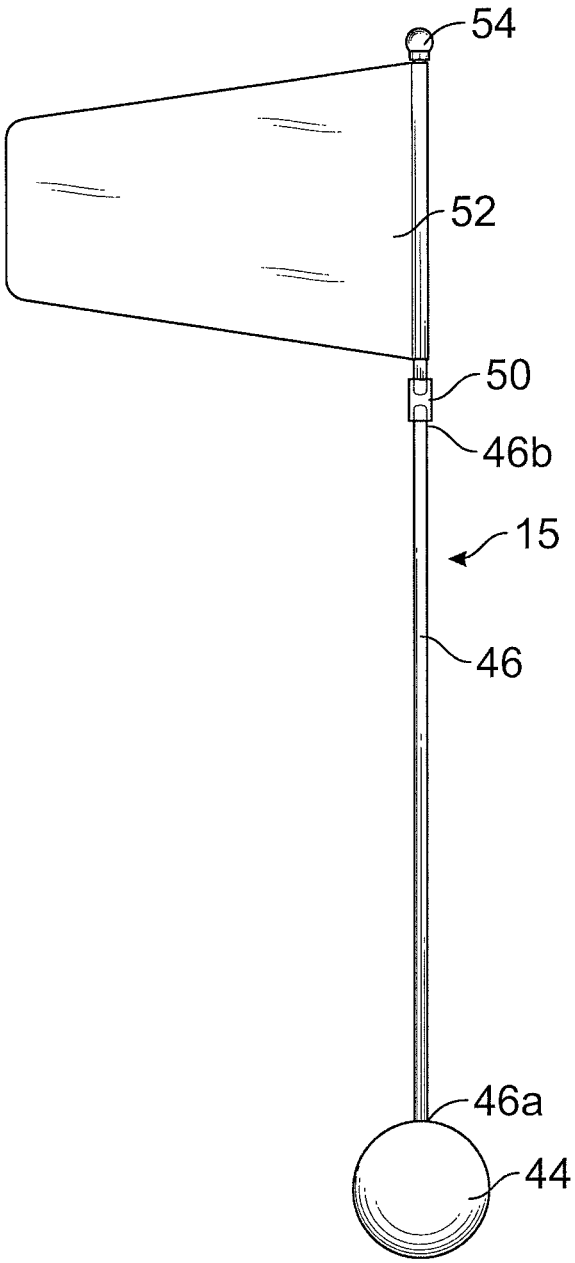
FIG. 9 is an elevational view of the flag and flotation means of the identification system of the present invention.

Referring now to the drawings, in one embodiment of the invention, a personal flotation device (PFD), here in the form of a life vest, 10 is shown, in FIG. 1, having an identification and location system 11 comprising a receptacle or pouch 12, a receptacle separator 14 and a buoyant locator/identifier 15 (most clearly shown in FIG. 9). The receptacle separator 14 acts as a divider between the life vest 10 and receptacle 12, allowing receptacle 12 to position itself angularly away from the life vest wearer's 17 head 19, allowing, as will be explained below, for the system 11 to be deployed while maintaining separation between the locator/identifier 15 and the wearer's head 19 in all directions. In this way, the identification and locator/identifier 15 can be deployed without disturbing the wearer 17. Additionally, when created with a flex material, as shown in the drawing figures, receptacle separator 14 allows receptacle 12 to distribute the forces created by the water entering the buoyant locator/identifier 15 such that it lessens the feeling that user being dragged or pulled by the extending flag 52.

Figure 3:
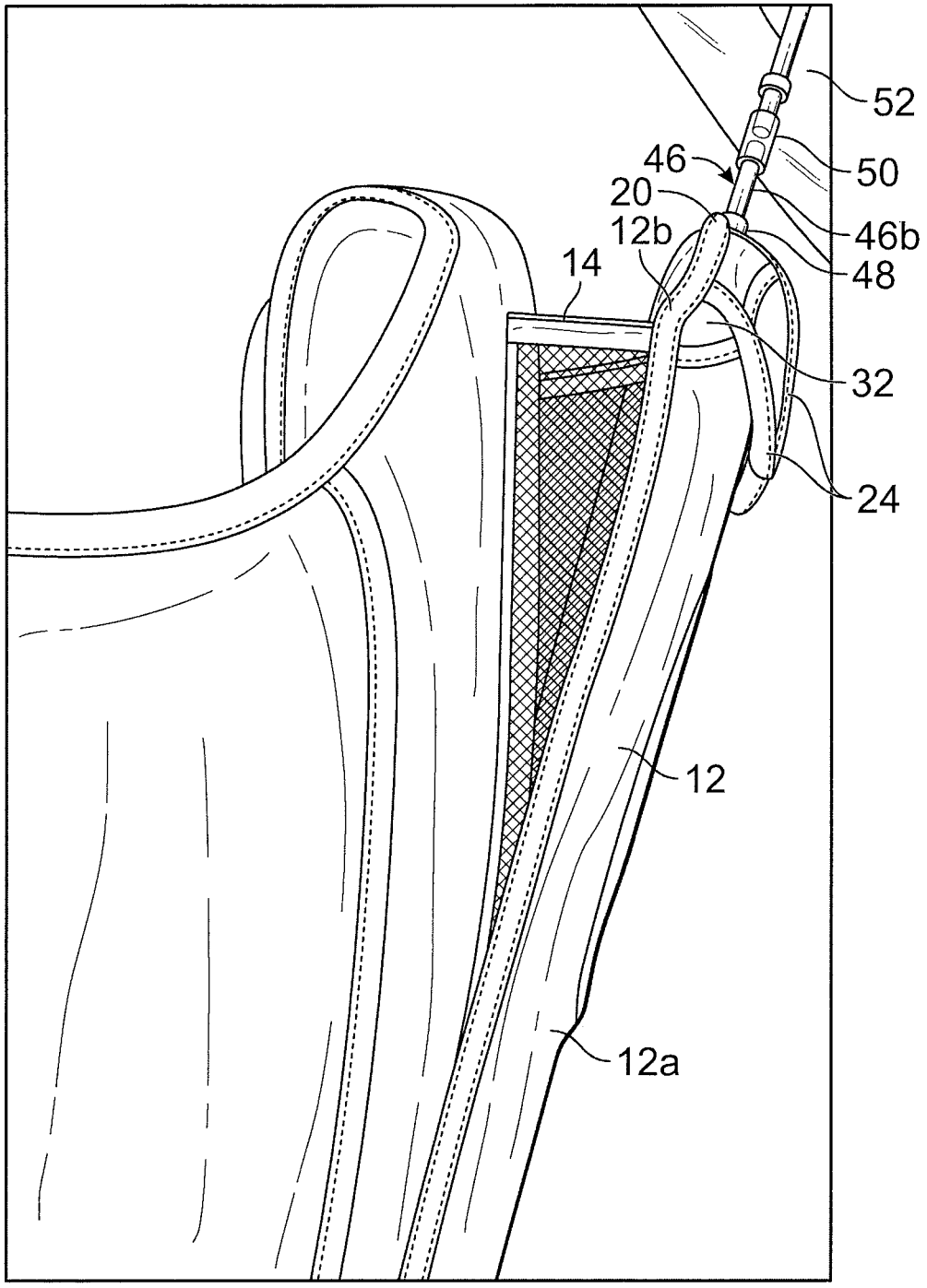
FIG. 3 is a left side perspective view of the PFD of the present invention.
Figure 10:
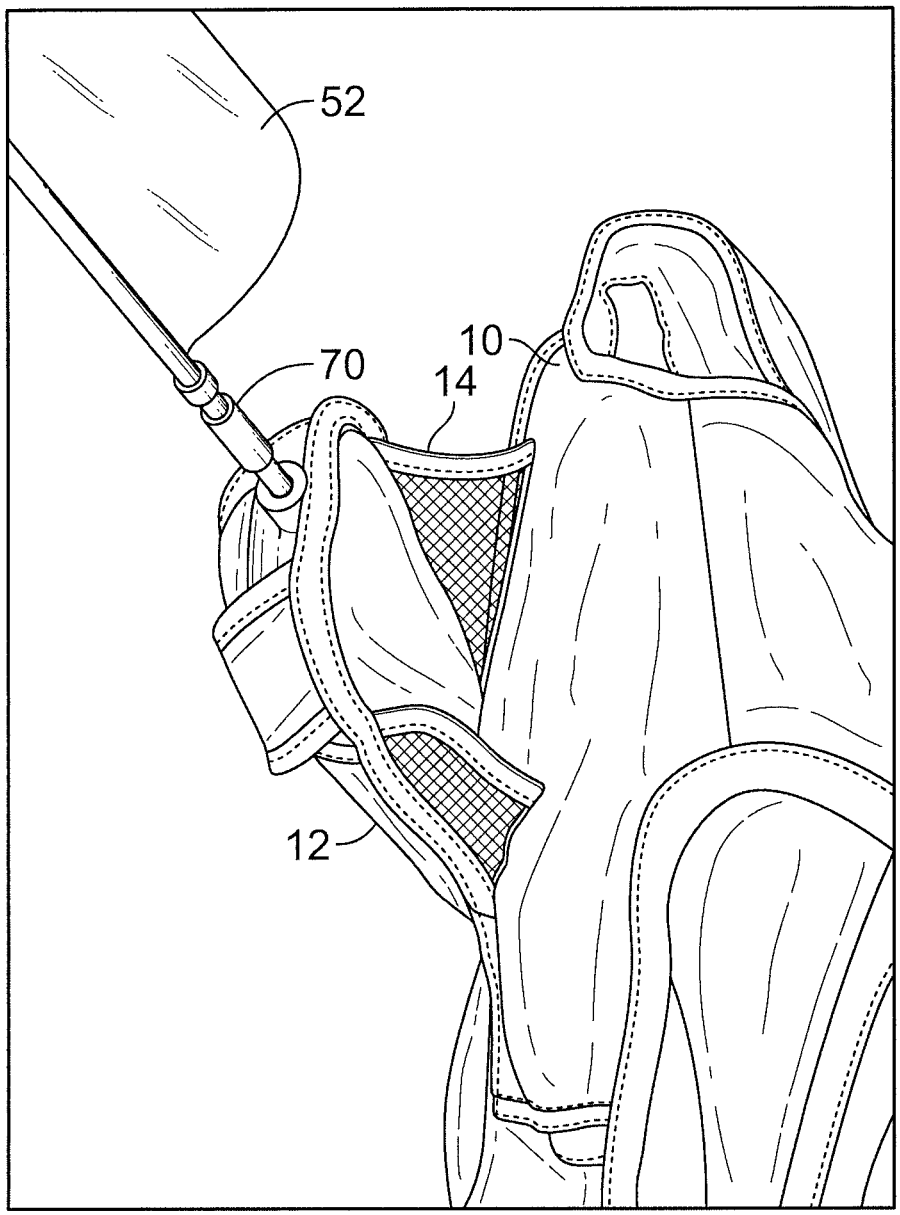
FIG. 10 is a top right perspective view of the identification system and PFD of the present invention.

In some embodiments, the receptacle separator 14 may be comprised of a durable, flexible material that angles the receptacle 12 away from the life vest 10 as substantially shown in FIGS. 3 and 10. In some embodiments of the present invention, separator 14 may be made out of a mesh material to allow the free flow of water therebetween and to decrease the overall weight of the life vest 10. It will be understood by persons having ordinary skill in the art that the separator 14 can be made from different materials and in different ways, including the use of materials that can flexibly attach the separator 14 to the life vest 10 so that the separator 14 can pivot away from the life vest 10, including one or more cord, chain, rope, or solid material panel or panels including such items made from cloth, plastic, metal or synthetic materials.

Figure 2:
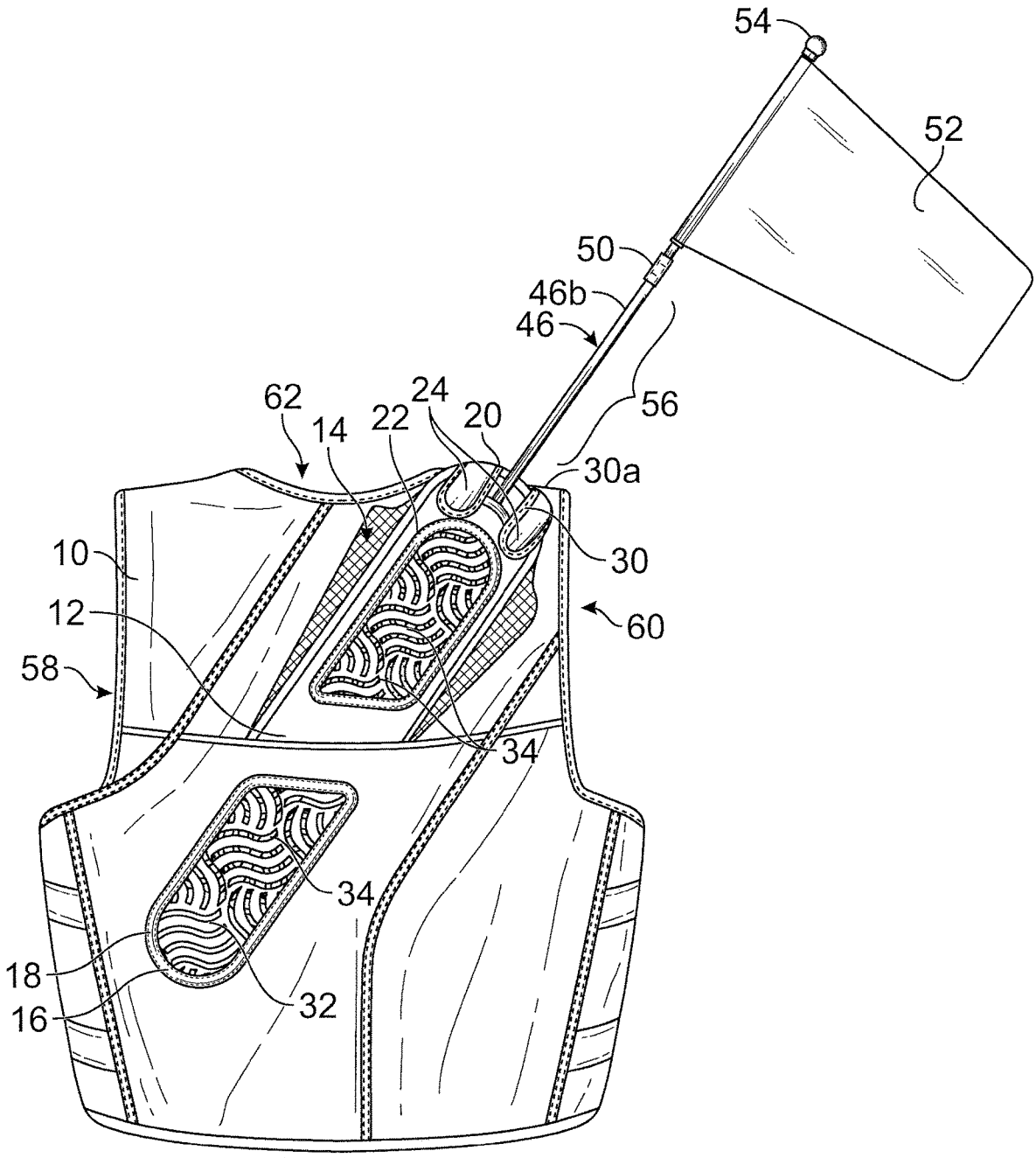
FIG. 2 is a rear elevational view of the PFD of FIG. 1 in an identification mode.

As shown in FIGS. 1 through 3 (and others), receptacle 12 comprises a front panel 12*a* and a rear panel 12*b*, a bottom 16, a lower opening or window 18 in front panel 12*a*, a top 20, and an upper window 22 in front panel 12*a*. Front panel 12*a* and rear panel 12*b* are attached together at their sides and bottoms to form receptacle 12, which as illustrated can be formed in the manner of a quiver for arrows, having an opening 30 in top 20 such that a locator/identifier 15 can be placed therein. While the term "window" is used in describing the openings in panel 12*a*, persons having ordinary skill in the art will understand that the "windows" are substantially panels of material perforated to allow water to more readily enter receptacle 12 when it is submerged but limiting the amount of open area so that structural integrity is maintained. The perforations 12*p* can be of any desired shape and can be made into a desirable pattern both for functional and aesthetic reasons. It will be understood, by persons having ordinary skill in the art that, receptacle 12 can be made in any manner that allows both the placement of a locator/identifier 15 and the infiltration of water therein, and that the illustrated embodiment is merely one exemplary of this element of the present invention. Further, it will be understood that locator/identifier 15 can be easily removed from receptacle 12 so that it can be cleaned, repaired or replaced as needed or removed to reduce weight in situations where the device is not needed.

In some embodiments, receptacle bottom 16 can be fully enclosed in a pre-formed shape, such as the curved edge shown in FIGS. 1 through 3 (and others); additionally, it will be seen that it is not necessary to attach the bottoms of panels 12*a* and 12*b* for their entire lengths in order to enclose locator/identifier 15; and that allowing the bottom to be partially open can aid in the entry of water into receptacle 12. In the present embodiment, lower window 18 comprises an open section in panel 12*a*, formed and configured to match the structure of receptacle 12 and is located adjacent to bottom 16; upper window 22 is placed adjacent to receptacle top 20 and comprises a similar structure to window 18. It will be understood by persons having ordinary skill in the art that the open sections in panel 12*a* can be made of different sizes and shapes from those show and from each other in anyone device.

Figure 4:
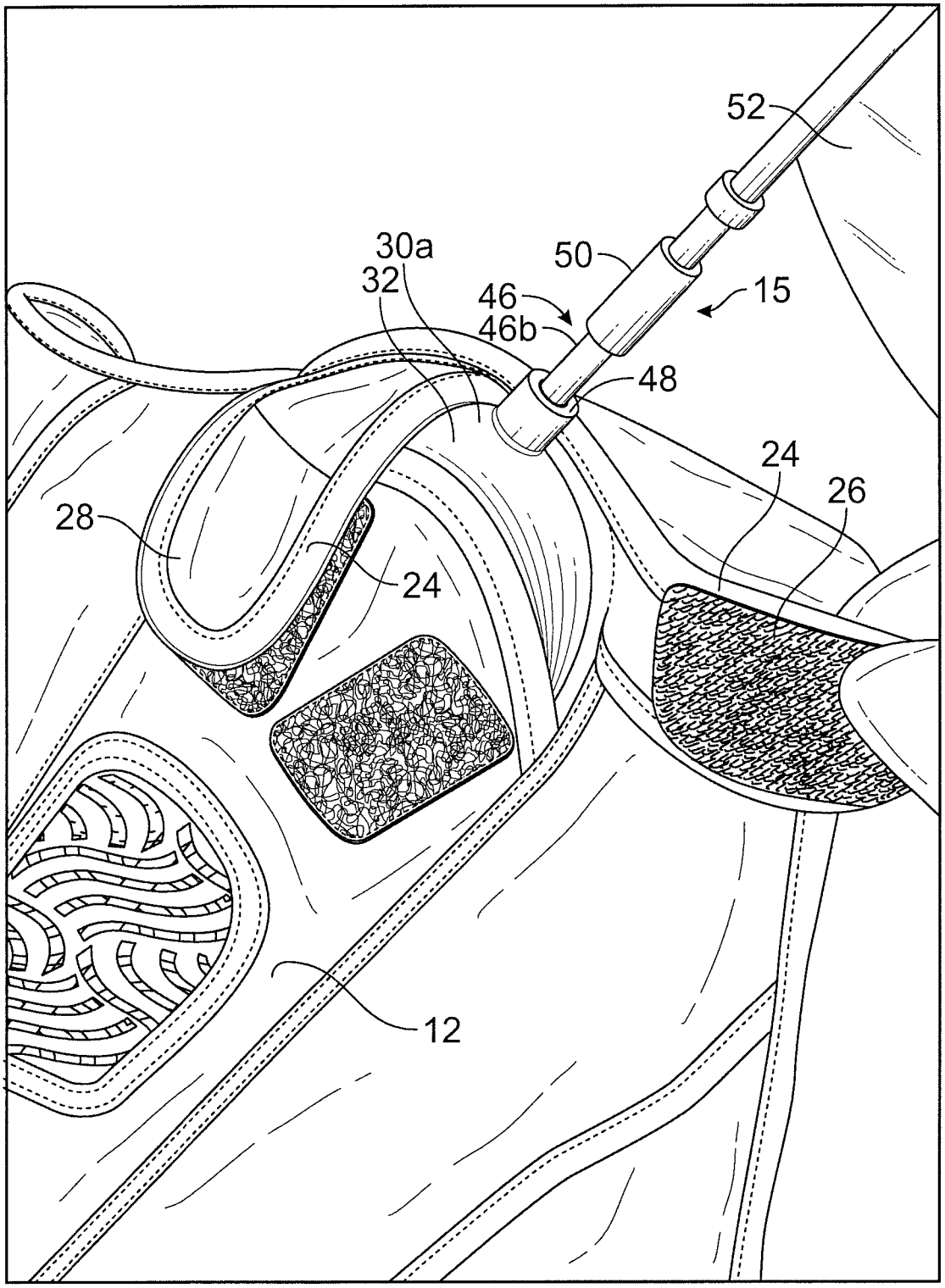
FIG. 4 is an elevational view of the identification system for use with a PFD of the present invention.

As shown in the figures, in the present embodiment, receptacle top 20 comprises flaps 24 adjacent to opening 30. It will be understood that flaps 24 can either be attached to receptacle 12 as separate sections or can be formed as part of rear panel 12*b*, wherein once assembled flaps 24 can extend over and onto front panel 12*a*, all without departing from the novel scope of the present invention. Each flap 24 individually extends alongside the edges of the receptacle top 20, partially covering opening 30 but allowing an open area 30*a* near the center of opening 30. As shown in FIG. 4, flaps 24, at top 20, comprise an exterior surface 28 and an interior surface 26 and flap interior surfaces 28 comprise fastening means such as, for example, hook and loop fasteners, snaps or buttons and others, to enclose and retain locator/identifier 15 within receptacle 12.

Figure 5:
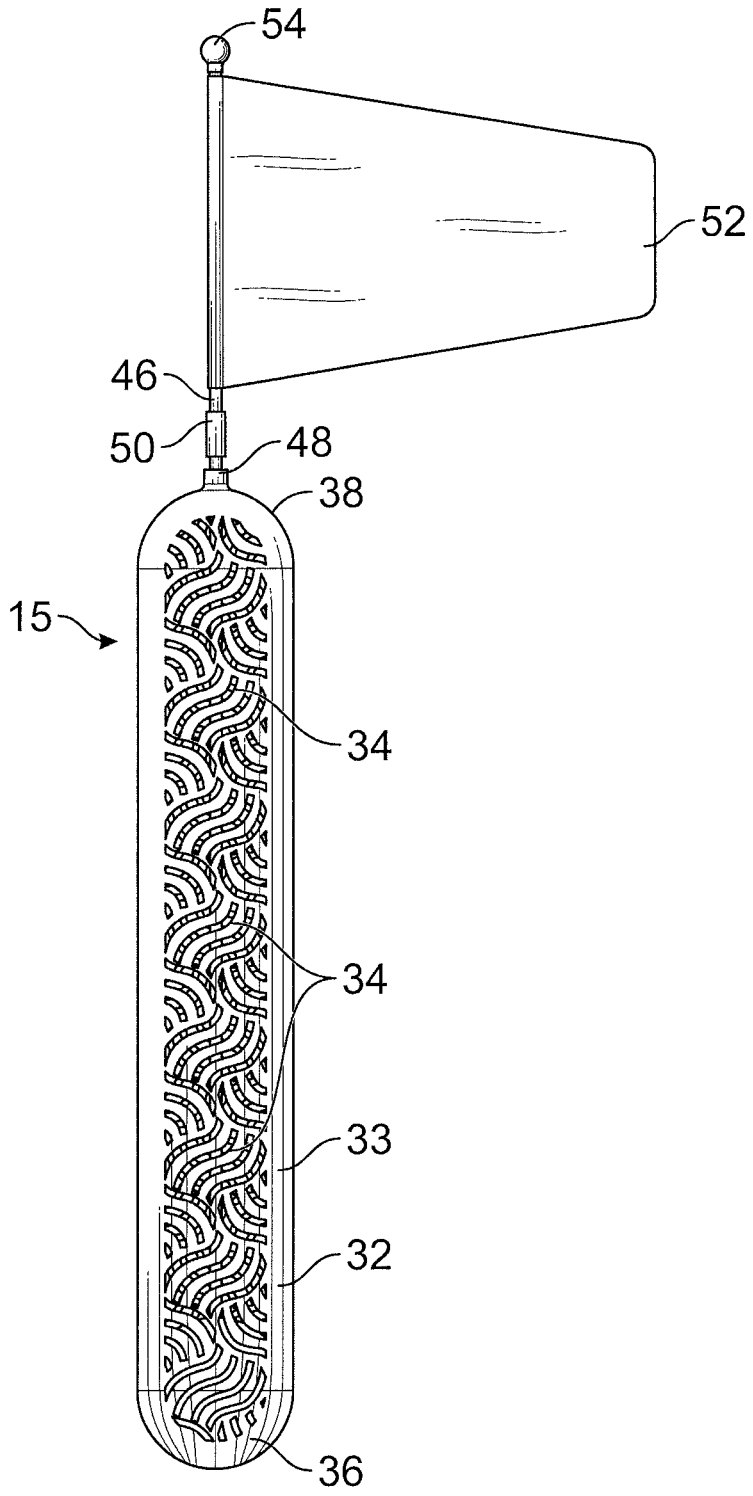
FIG. 5 is a cut-away elevational view of the identification system for use with a PFD of the present invention.
Figure 6:
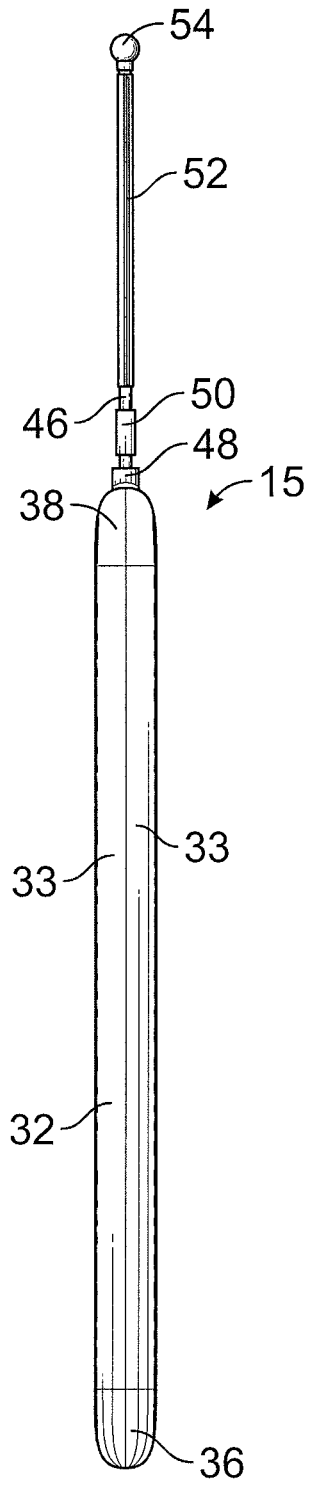
FIG. 6 is a front elevational view of the identification system of the present invention.
Figure 7:
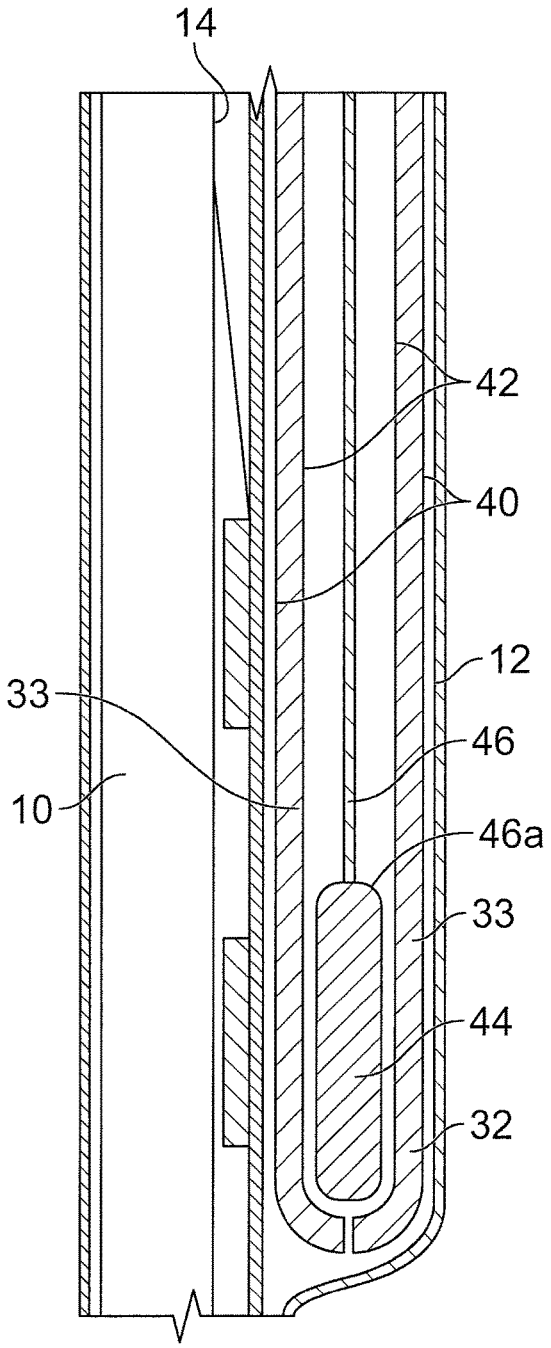
FIG. 7 is a side elevational view of the identification system of the present invention.

Referring now to FIGS. 5 and 6, there is shown the elements of locator/identifier 15, shown outside of receptacle 12 for illustrative purposes. It will be seen that locator/identifier 15 comprises a housing 32 created to fit closely within and work in cooperation with receptacle 12. Housing 32 comprises a first and second body shell 33 sealed together with a formed top 38 and bottom 36. Persons having ordinary skill in the art will understand that housing 32 can be created in any manner that provides a structural enclosure for the elements of locator/identifier 15. Referring now to FIG. 7, which is a cut-away illustration of elements, in place, of life vest 10, receptacle 12, separator 14 and locator/identifier 15. It will be seen that housing 32 has an exterior surface 40 and an interior surface 42; housing support exterior surface 40 is shown adjacent to the inner surface 12*i* of receptacle 12. In the present embodiment, the housing 32 is shown to be comprised of two separate sections 33 fastened together using any one or more of adhesives, fasteners (such as screws, rivets, plastic connectors, metal connectors), or molded together in any number of processes well known to persons having ordinary skill in the art.

FIG. 7 further illustrates a float 44 and a mast or pole 46 within housing 32; float 44 is shown adjacent to the housing interior surfaces 42 and is generally circular in shape to fit within the bottom 36 of housing 32. It will be seen in FIG. 9 that float 44, in the preferred embodiment, is disk shaped and formed either of buoyant materials or as an empty shell to provide buoyancy. A mast 46 connects to float 44 at a first end 46*a* and its second end 46*b* extends through the hollow housing 32 (see, FIGS. 6 and 8). As shown in FIGS. 5 and 6 the mast 46 exits the housing 32 through the housing end-hole 48 located at the top portion of housing 32. It will be understood that mast 46 can be comprised of either substantially rigid or substantially flexible material depending on the application of the locator/identifier 15 and other aspects of the present invention. In some embodiments, the mast 46 may be comprised of a substantially soft flexible, extremely lightweight material that has a tendency not to absorb water or other liquids.

Figure 1A:
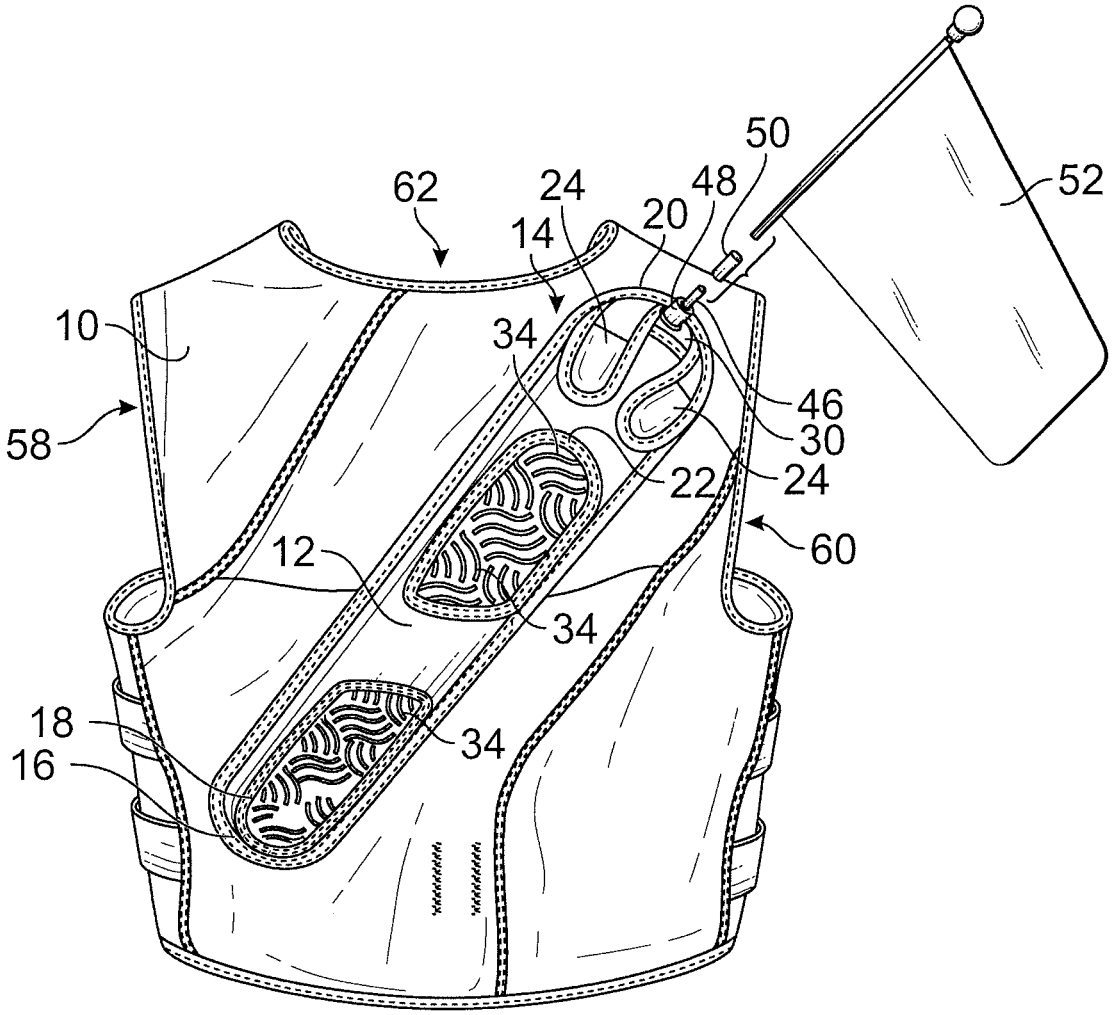
FIG. 1A is a rear elevational view of the PFD of FIG. 1.

As shown in FIG. 9, locator/identifier 15 comprises a mast 46, a stopper 50, a flag 52, and an end cap 54, and as shown in FIG. 6, mast 46 is held partially outside of housing 32 and stopper 50, flag 52 and end cap 54 are entirely outside of housing 32. Stopper 50 is designed to provide a connection point for flag 52, such that different flags can be interchanged to provide a variety such that the wearer can be more readily found amongst other such devices in use. Referring to FIG. 1A, it can be seen that the flag 52 can be removed from mast 46 for storage or to interchange flags.

In a case where a mast that is of smaller length is used, the stopper 50 further limits the amount of retraction of the mast 46 into the housing 32 and also keeps flag 52 from sliding into housing 32. Stopper 50 and end cap 54 are formed to the shape and size of mast 46 on each end of the flag 52 as shown in FIGS. 5 and 6. In some embodiments, stopper 50 can be comprised of one main section or two separate sections. Stopper 50 and/or the end cap 54 can be either statically or dynamically positioned on mast 46. Further, stopper 50 and/or end cap 54 can be comprised of a substantially soft or substantially rigid material that has the tendency not to absorb water or other liquids. End cap 54 in a preferred embodiment is rounded so as to help prevent injury from an unprotected mast 46. In yet another form, flag 52 may contain a message area where messages or other information can be placed on flag 52 itself, as an additional safety measure (such things as a telephone number or identifying information can be placed thereon).

Referring again to FIGS. 5 and 6, housing 32 further comprises a housing support end hole 48, extending from the receptacle opening 30 (as shown in FIGS. 1-3). In some embodiments, the receptacle flaps 24 adjacently form and fasten around the housing support end hole 48 as shown in FIGS. 1 to 5.

In one embodiment of the invention, float device 44, when outside of water, sits in its neutral position adjacent to the bottom portion of the housing 32. In some embodiments, float device 44 can be comprised of a substantially solid but buoyant cylinder such as a hockey puck. In an alternative form, float device 44 may be substantially cylindrical with a hollow or solid core either substantially larger or smaller than a hockey puck. In yet other forms, the cross-sectional area of the housing 32 and/or float device 44 may be square, octagonal, circular, or a variety of other shapes and cross-sections provided that float device 44 can intake sufficient amount of force to raise or extend the flag system 15. In an alternative embodiment, float device 44 is not required; in this form, mast or pole 46 acts as the float device within the housing 32.

Figure 8:
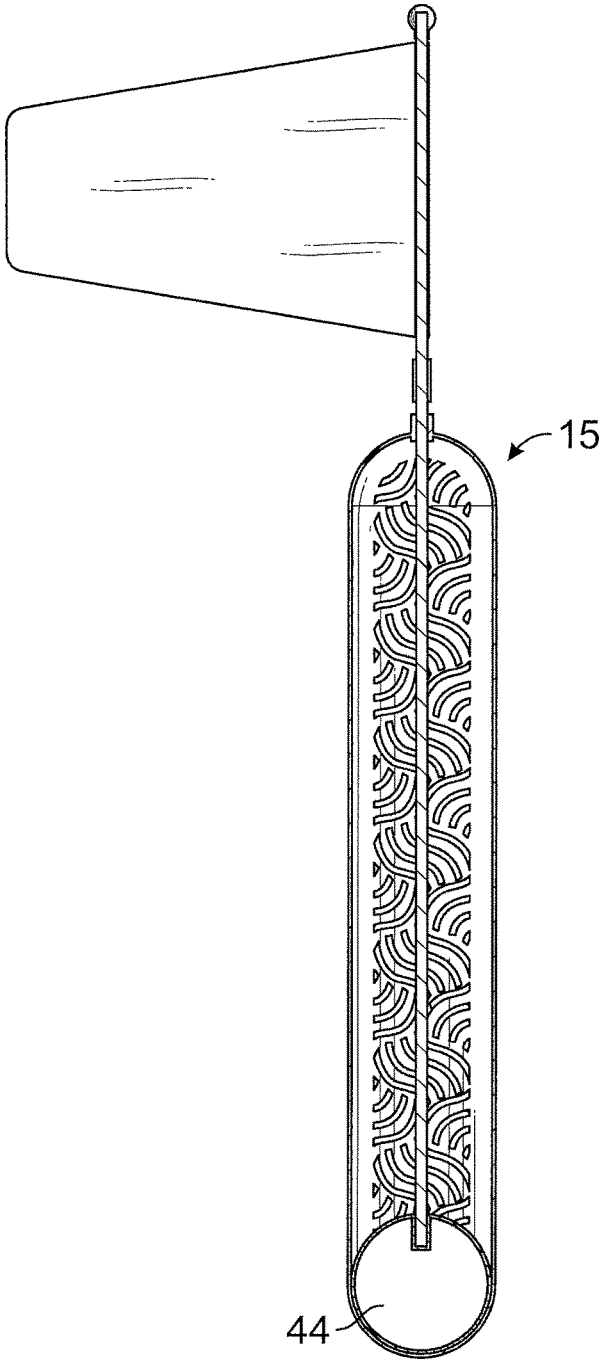
FIG. 8 is a cut away rear elevational view of the identification system of the present invention.
Figure 12:
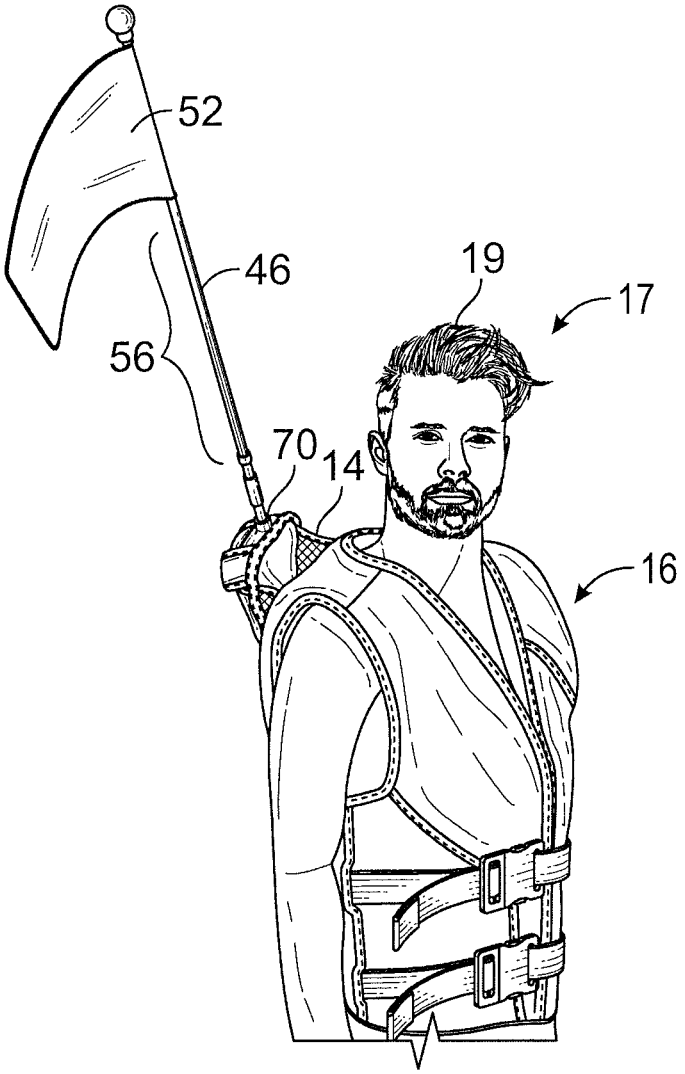
FIG. 12 is a perspective view of the PFD of the present invention with the identification system deployed.

Referring to FIGS. 5 and 8, it will be seen that housing 32 may be have a plurality of water inlet openings 34, a housing bottom 36, and a housing top 38. In some embodiments, housing bottom 36 and housing top 38 can be formed and connected by flat surfaces of housing 32. All of the flat surfaces of housing 32 may comprise water inlet openings 34; such openings 34 can be spaced in a curved or wave-like configuration as illustrated in FIG. 5 or in any manner fixed or random as desired or desirable. In an alternative form, housing 32 can be made either entirely or partially of screen or mesh materials and the water inlet openings 34 can then be part of such screen or a mesh material. FIGS. 2 and 12 show the device in use with mast 46 extended through length 56, to illustrate the mechanism of the life vest system 10 when the float device 44 is forced upward from water entering the housing 32 through the water inlet holes 34.

Figure 11:
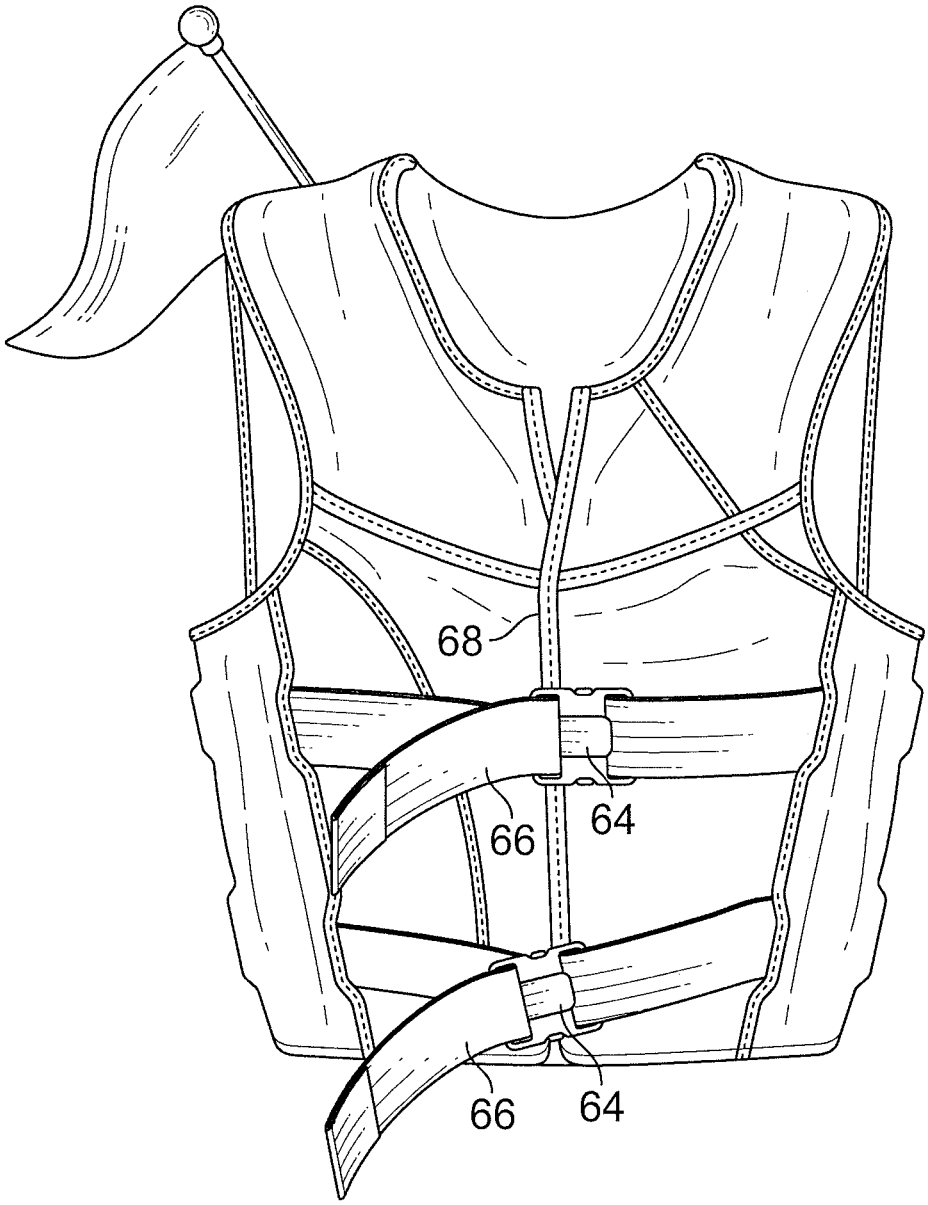
FIG. 11 is a front elevational view of a PFD of the present invention.

FIGS. 1-2 and 11 further illustrate the traditional structures of a life vest such as a left arm opening 58, a right arm opening 60, a neck opening 62, a front vest locking system 64, adjustable straps 66, and a front zipper 68. In an alternative embodiment, these traditional structures may be adjusted in shape, size, and/or configuration to better equip to the life vest system 10. Further, it will be understood that the vest of the present invention can be created with neutral buoyancy such that the wearer can be in the water and not in a lifesaving position (that is the buoyancy of the vest of the invention need not lift and, as necessary, rotate the wearer to place the wearer's face at the surface)—as the vest can be used while playing, the lifesaving mode is not necessary to daily use and would inhibit play. Instead the vest could act as water wings to help buoy the user without inhibiting play. Additionally, as shown in FIG. 12, the device can include a locking ring 70, or like item, to clamp flag 52 in an erect position while out of the water, so as to help identify and locate the wearer on land. Locking ring 70 can be made in any manner well known to persons having ordinary skill in the art.

Figure 13:
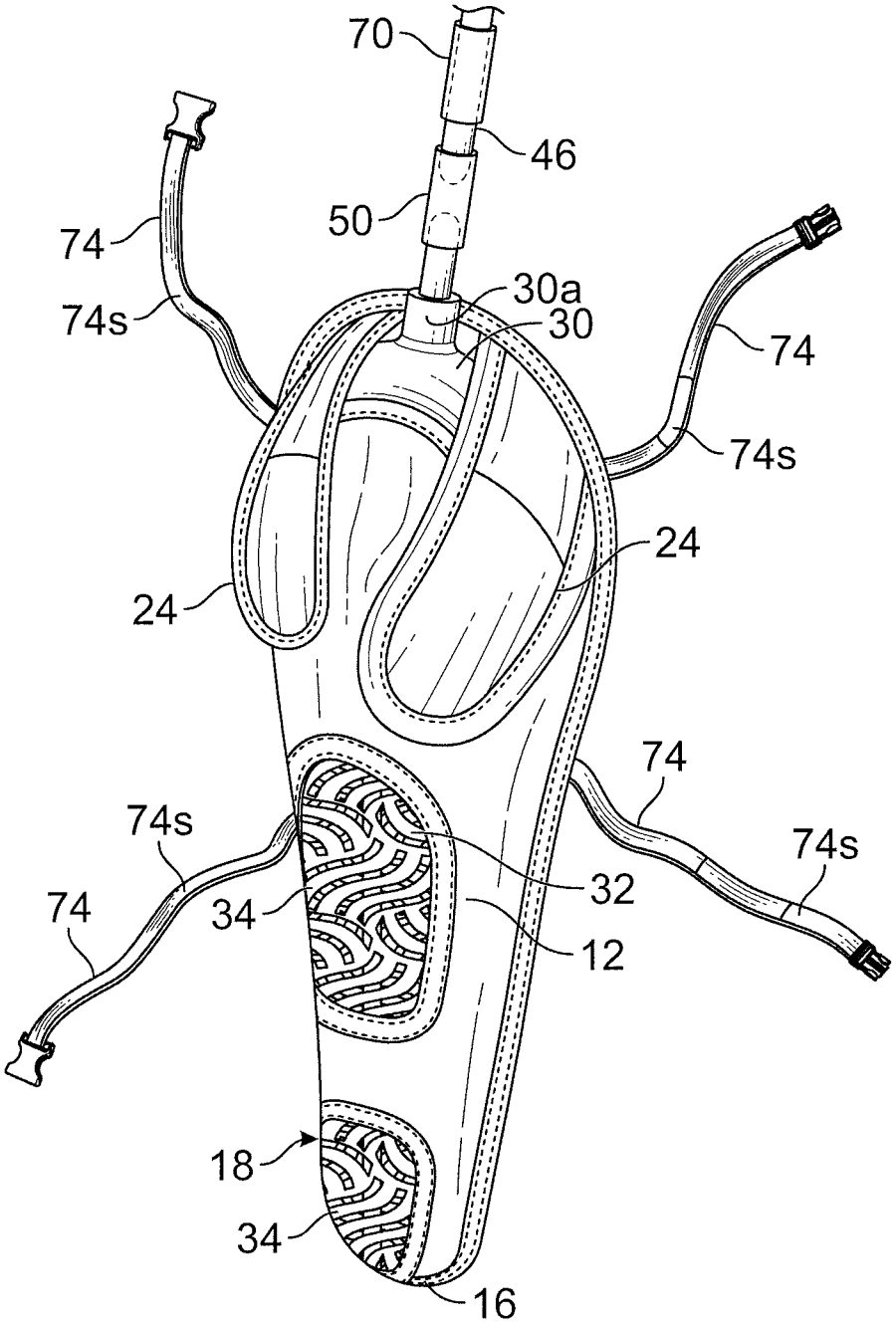
FIG. 13 is a perspective view of another embodiment of the present invention.
Figure 14A:
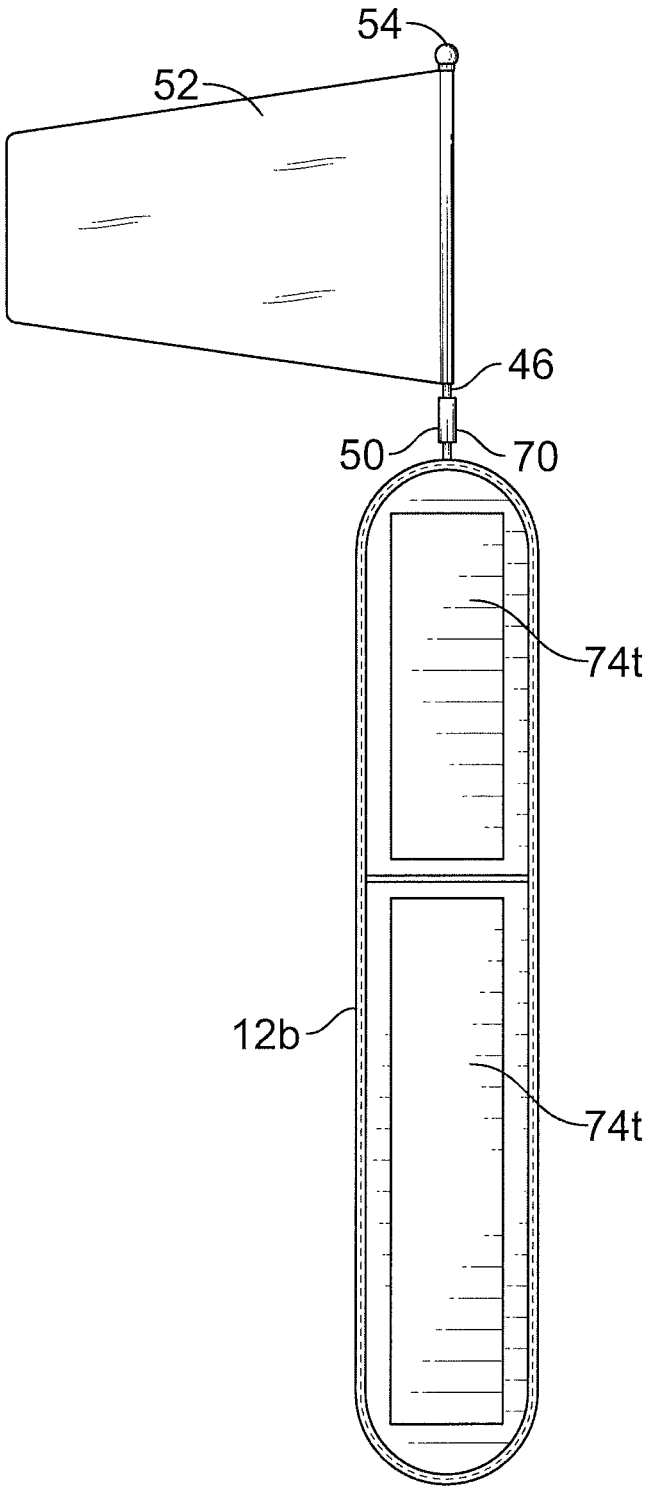
FIG. 14A is rear elevational view of the rear of one embodiment of the device of FIG. 13.
Figure 14B:
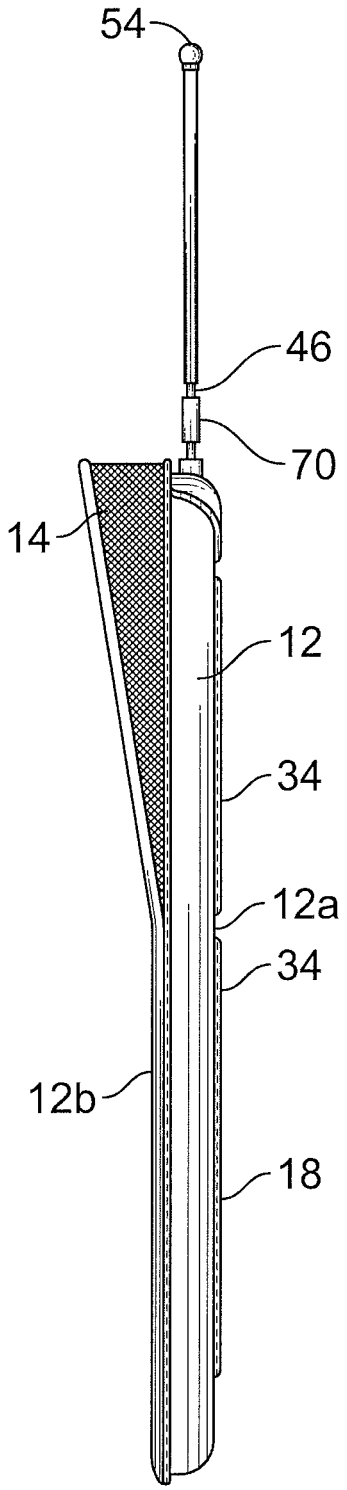
FIG. 14B is a side elevational view of the device of FIG. 14A.
Figure 14C:
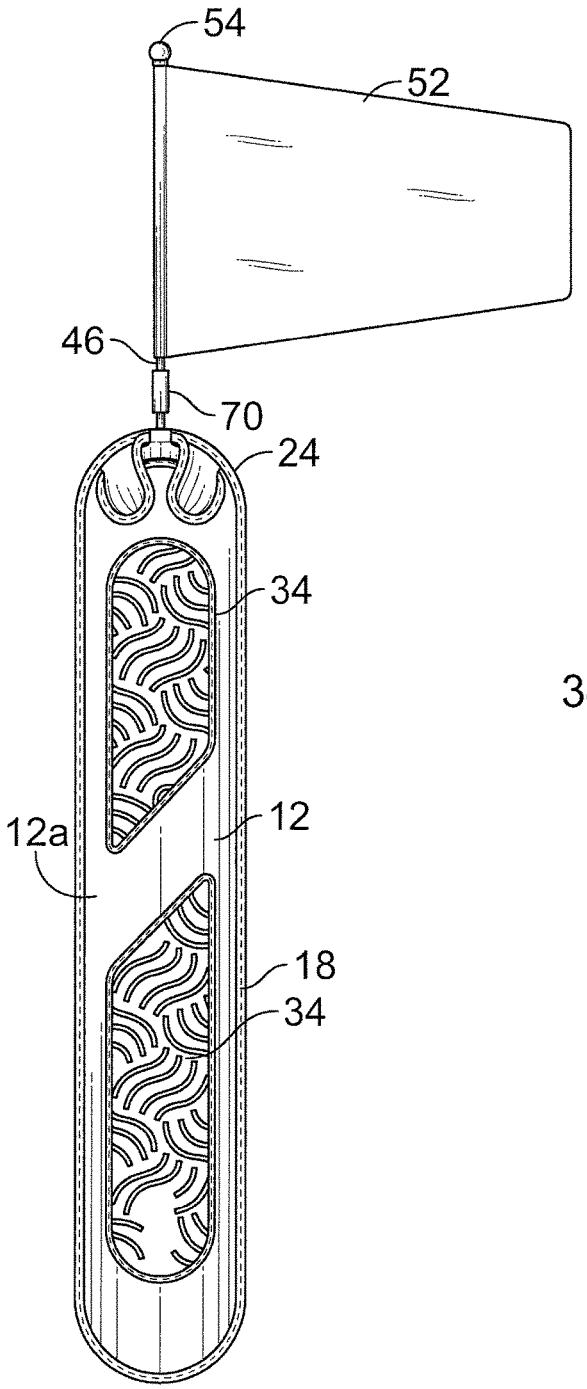
FIG. 14C is a front elevational view of the device of FIG. 14A.
Figure 14D:
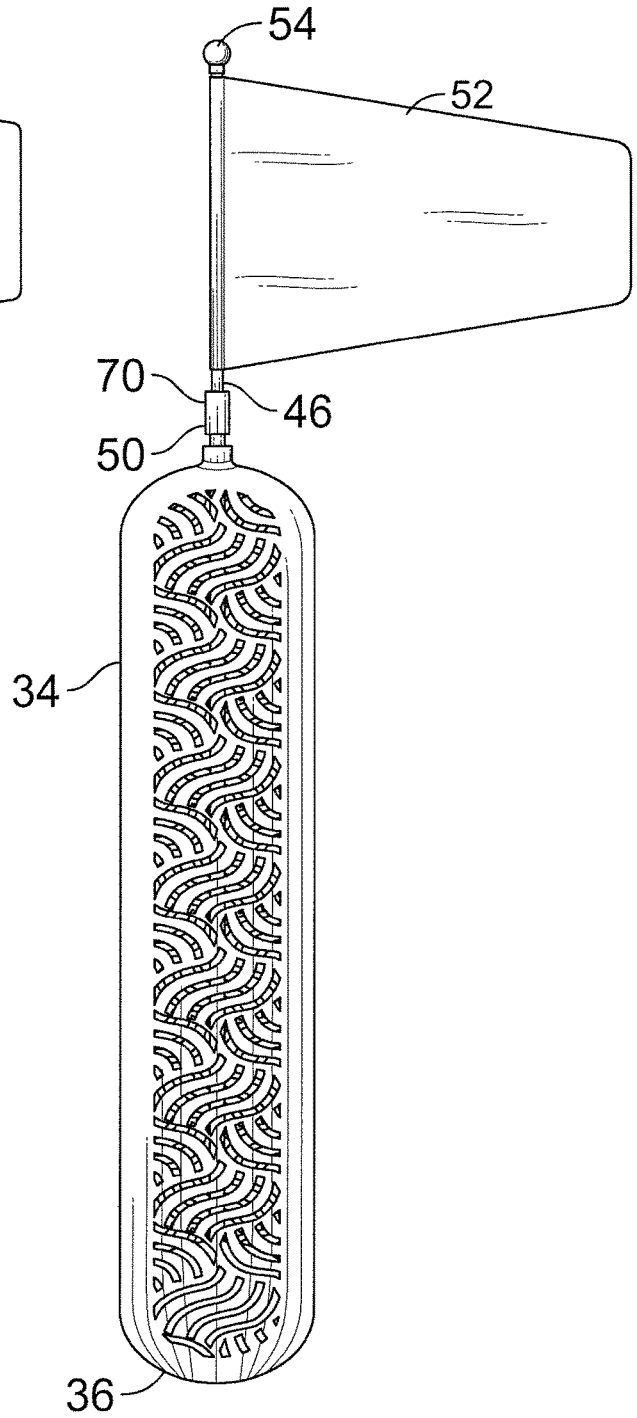
FIG. 14D is a view of one type of identification and location device for use in the receptacle shown in FIG. 14A.

It will be understood that an identification and location system 11 made of a receptacle or pouch 12, a receptacle separator 14 and a buoyant locator/identifier 15 can be made separate from a PFD 10, as shown in FIG. 13, and provided with attachment means 74, such as the strap system shown, so that it can be worn separately, or with fasteners, such as hook and loop fasteners or snaps (not shown) so that it can be added to existing PFDs 10 or any type of clothing or object, to provide similar passive identification and location means in other situations where floatation and water are not necessarily and an issue, but location in large crowds is paramount, without departing from the novel scope of the present invention.

The above described location and identification systems and their components can be made of a variety of different materials. In some embodiments, it can be made of plastic, metal, wood, foam, nylon and/or a variety of different materials and/or combination of materials to allow for proper operation of the life vest system as described herein. Specific embodiments of novel methods and apparatus for construction of the Personal Flotation Device with Passive Location and Identification System and Method of Use according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

What is claimed is:

1. A personal flotation device (PFD) having a passive identification and location element, comprising:

a garment, to be worn about a torso, having a back panel and a front panel, the back and front panels being fixed together to form the garment, the garment providing buoyancy in water;

a pouch attached to the garment at the back panel, the pouch comprising an opening at the top and being permeable to water along its length;

a container for placement in the pouch, the container comprising a bottom, a top and walls, the walls having openings therein to allow the container to fill with water when placed in water;

a flotation device attached to a mast and an identifying element attached to the mast, the flotation device and mast being placed within the container, the flotation device resting generally at the bottom of the container when not in water, the flotation device configured to freely slide substantially within the entire length of the container, the mast being extendable from the flotation device, out from the top of the container;

wherein, when the PFD is placed in water, the container fills with water and the flotation device within the container is caused to float within the container rising such that the attached mast extends distally from the container in a generally upward direction carrying the identification device therewith.

2. The personal flotation device (PFD) having a passive identification and location element of claim 1, wherein the identification device is a flag.

3. The personal flotation device (PFD) having a passive identification and location element of claim 1, wherein the garment is a life vest.

4. The personal flotation device (PFD) having a passive identification and location element of claim 1, including a locking element about the mast such that the mast can be extended manually and locked in an erect position.

5. The personal flotation device (PFD) having a passive identification and location element of claim 1, wherein the garment comprises flotation materials that provide a neutral buoyancy to a wearer.

6. The personal flotation device (PFD) having a passive identification and location element of claim 1, wherein the garment provides lifesaving buoyancy to a wearer.

7. The personal flotation device (PFD) having a passive identification and location element of claim 1, wherein the flotation device is made so as to fit closely within the container such that the container comprises a linear path for the flotation device to take when the PFD is placed in water.

8. The personal flotation device (PFD) having a passive identification and location element of claim 7, wherein the container is placed at an acute angle relative to vertical, such that when the mast and identifying element extend from the container, it is at an angle away from a wearer's head.

9. The personal flotation device (PFD) having a passive identification and location element of claim 1, wherein the pouch is attached to the garment using mesh webbing.

10. The personal flotation device (PFD) having a passive identification and location element of claim 1, wherein the identifying element is a flag.

11. A passive identification and location element for removable attachment to a person, comprising:

a pouch, having means to connect on a person, comprising an opening at the top and being permeable to water along its length;

a container for placement in the pouch, the container comprising a bottom, a top and walls, the walls having openings therein to allow the container to fill with water when placed in water;

a flotation device attached to a mast and an identifying element attached to the mast, the flotation device and mast being placed within the container, the flotation device resting generally at the bottom of the container when not in water, the flotation device configured to freely slide substantially within the entire length of the container, the mast being extendable from the flotation device, out from the top of the container;

wherein, when the passive identification and location element is attached to on a person and is placed in water, the container fills with water and the flotation device within the container is caused to float within the container rising such that the attached mast extends distally from the container in a generally upward direction carrying the identification device therewith.

12. The passive identification and location element for removable attachment to a person, of claim 10, wherein the pouch can be attached to an existing garment.

13. A method of using a passive identification and location device; including the steps of:

providing a water permeable container;

providing a buoyant element and mast within the container, the mast having a proximal end and a distal end, the buoyant element being adjacent the proximal end of the mast, the distal end of the mast extending out from the container;

providing an identification element, connectable to the distal end of the mast;

providing means to removable attach the container on a person including a pouch with flexible flanges, such that the container is placed in the pouch which is connected to on the person through the flanges, thereby allowing the identification means to advantageously angle away from the person when in use;

attaching the identification element to the mast; and attaching the container on the person and causing the buoyant element to rise within the container, pushing the mast further out from the container and raising the identification element.

14. A method of using a passive identification and location device; including the steps of:

providing a water permeable container;

providing a buoyant element and mast within the container, the mast having a proximal end and a distal end, the buoyant element being adjacent the proximal end of the mast, the distal end of the mast extending out from the container;

providing an identification element, connectable to the distal end of the mast;

providing means to removable attach the container on a person;

attaching the identification element to the mast;

including a clip, such that a user can raise the mast and identification means by pulling thereon, and then place the clip on a portion of the mast extending out from the container and near the proximal end of the mast, so as to keep the identification means and mast extended and attaching the container on the person and causing the buoyant element to rise within the container, pushing the mast further out from the container and raising the identification element.

* * * * *